US005446275A

United States Patent [19]

Sakai et al.

[11] Patent Number: 5,446,275

[45] Date of Patent: Aug. 29, 1995

[54] ELECTRON MULTIPLYING DEVICE HAVING MULTIPLE DYNODE STAGES ENCASED BY A HOUSING

[75] Inventors: Shiro Sakai; Takehisa Okamoto; Makoto Nakamura; Haruhisa Yamaguchi; Tetsuya Morita, all of Hamamatsu, Japan

[73] Assignee: Hamamatsu Photonics K.K., Hamamatsu, Japan

[21] Appl. No.: 63,418

[22] Filed: May 19, 1993

[30] Foreign Application Priority Data

May 20, 1992 [JP] Japan ..... 4-127702

[51] Int. Cl.[6] ..... H01J 40/14

[52] U.S. Cl. ..... 250/207; 250/283; 250/397

[58] Field of Search ..... 250/207, 214 VT, 283, 250/299, 397; 313/105 CM, 103 CM, 533, 534, 536, 532, 528

[56] References Cited

U.S. PATENT DOCUMENTS

| | | | |
|---|---|---|---|
| 2,952,499 | 9/1960 | Carson . | |
| 3,254,209 | 5/1966 | Fite et al. | 250/299 |
| 3,272,986 | 9/1966 | Herzog et al. . | |
| 4,431,943 | 2/1984 | Faulkner et al. | 313/533 |
| 4,668,890 | 5/1987 | Swingler . | |

FOREIGN PATENT DOCUMENTS

| | | |
|---|---|---|
| 62-64042 | 3/1987 | Japan . |
| 046741 | 1/1992 | Japan . |
| 04160728 | 6/1992 | Japan . |
| 04233151 | 8/1992 | Japan . |

OTHER PUBLICATIONS

"The Mass Spectrometry Using Radiosotopes As An Ion Source", M. Aratani et al., vol. 19, No. 3, pp. 195–203 Sep. 1971.

"Ion Detector", Ouyoubutsuri, vol. 37, No. 1 Jan. 1968.

"Basic Properties of Electron Multiplier Ion Detection and Pulse Counting Methods In Mass Spectrometry", The Review of Scientific Instruments, vol. 36, No. 12, L. A. Dietz pp. 1763–1770, Dec. 1965.

"Mass Spectroscopic Studies On The Mechanism of Ionization of Atoms Formed as a Result of Radioactive Decay Processes" (I), Feb. 1970, M. Aratani, vol. 18, pp. 906–919.

*Primary Examiner*—David C. Nelms
*Assistant Examiner*—Que T. Le
*Attorney, Agent, or Firm*—Cushman Darby & Cushman

[57] ABSTRACT

The electron multiplying device according to this invention comprises an electron multiplying unit including dynodes arranged in a plurality of stages. The electron multiplying unit has an incidence opening for an energy beam to be multiplied to enter through, and has the proximal end secured to a base. There is provided a casing for housing the electron multiplying unit. The forward edge of the casing is secured to the base, and a space defined by the base and the casing houses the electron multiplying unit. The casing has an entrance window formed at a position opposed to the incidence opening. Energy beams enter the electron multiplying unit through the entrance window, but the electron multiplying unit itself is housed in the casing to be protected from surrounding air flow and unnecessary energy beams not to be measured.

21 Claims, 9 Drawing Sheets

ELECTRON MULTIPLYING DEVICE HAVING MULTIPLE DYNODE STAGES ENCASED BY A HOUSING

BACKGROUND OF THE INVENTION

1. Field of the Invention

This invention relates to an ion (electron) multiplying device for detecting or measuring energy beams of electrons, ions, charge particles, ultraviolet rays, soft X-rays, etc.

2. Related Background Art

As schematically shown in FIG. 1, in an ion multiplying device, energy beams, as of electrons or others, impinge on dynodes of the ion multiplying unit to multiply and emit secondary electrons, and the collecting electrodes (anodes) A collect the emitted secondary electrons for detection.

The ion multiplying units have various types. Conventional quarter-cylindrical dynodes are substantially alternately arranged in a direction of incidence of energy beams. The arrangement of FIG. 1 is the typical one which is the so-called box-and-grid-type.

Resistors are inserted between the respective dynodes DY and their adjacent ones. The resistors equidivide a voltage applied between a first-stage dynode DY1 and a final-stage dynode DY 16.

This is the basic structure of the ion multiplying units. The general actual assembly of the ion multipliers is shown in FIGS. 2 and 3.

In the ion multiplier of FIGS. 2 and 3, respective dynodes DY are supported, enclosed by respective support frames 1. Each support frame 1 is made of a conducting material and is electrically connected to the associated dynode DY. The ion multiplier further comprises two support rods 3 which are secured to a holder 2 of a thin steel plate and are parallel with each other. These support rods 3 are inserted in holes 4 of each support frame 1 to support the dynodes by the support rods 3. A gap between each support frame 1 and its adjacent one is retained constant by spacers 5 through which the support rods 3 are inserted.

In this conventional ion multiplying device, resistors R are disposed in one row on one of the rows of the dynodes. Leads L of each resistor R are welded respectively to vertically adjacent ones of the support frames 1.

For the measurement of energy beams, as of ions, the above-described ion multiplying device is installed in a vacuum vessel with an energy beam source built in. But it is a problem that when the holder 2 of a thin steel plate is not strong enough to install the device in the vessel. In addition, the dynodes are exposed, and need careful handling.

The installation of the ion multiplying device is followed by drawing air out of the vessel, But the dynodes, which are exposed in the vessel, are subjected to air streams when the air of the vessel is evacuated. Sometimes the air streams contain dust, and the dust sticks to the surfaces of the dynodes, which may cause erroneous measurements. This problem also occurs when, after measurements, the vacuum vessel is released, and air flows into the vessel from the outside. Also in operations in vacuum, oil used in a vacuum pump, sample solvents may be attached onto the surfaces of the dynodes, and as the result, gain of the multiplying device may be degraded.

Furthermore, in some cases energy beams not to be measured, e.g., scattered energy beams, are incident on the sides of the ion multiplying device to enter the exposed dynodes. For analysis of ions of some kinds, plasmas are used, and in some cases, ultraviolet radiation from the plasmas are incident on the dynodes. These energy beams are a cause for noises.

SUMMARY OF THE INVENTION

In view of these problems, this invention has been made. An object of this invention is to provide an ion multiplying device which has sufficient strength and is easy to handle, and can prevent the intrusion of unnecessary energy beams.

An ion multiplying device according to one preferred embodiment of this invention comprises an ion multiplying unit including a plurality of dynodes arranged in a plurality of stages, and having an incidence opening for an energy beam to be multiplied to enter through, a base for supporting the ion multiplying unit, and a casing secured to the base, housing the ion multiplying unit, and having an entrance window for the energy beam to enter through formed at a position opposed to the incidence opening.

It is preferable that the incidence opening of the ion multiplying unit has substantially the same shape as the entrance window of the casing.

The casing is formed of a magnetic metal.

It is preferable that the ion multiplying device further comprises support plates for mounting the dynodes arranged in a plurality of stages, proximal ends of the support plates being secured to the base.

The casing may have positioning slots formed therein;

the support plates have tabs to be inserted in the slots when the casing is secured to the base.

It is preferable that the ion multiplying device further comprises a filler plate, the filler plate filling a gap defined by a surface of the casing with the entrance window formed in, and surface of the ion multiplying unit with the incidence opening formed in when the casing is secured to the based, and the filler plate has an opening at a position opposed to the incidence opening and the entrance window.

The ion multiplying device further comprises an energy beam introducing hole having an exit opening opposed to the incidence opening for the energy beam to enter through, and to the entrance window of the casing, and an energy beam introducing member for absorbing the energy beam incident on the inside surface of the introducing hole, the energy beam passing through the energy beam introducing member and directly enter the entrance window of the casing to be multiplied.

It is preferable that the energy beam introducing member has a larger opening than the incidence opening, and comprises a black-colored plates disposed in a plurality of stages spaced by a certain interval.

It is preferable that the ion multiplying device is installed in a vacuum vessel residual air in which is evacuated, and an interior of which is maintained at a set degree of vacuum.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

BRIEF DESCRIPTION OF THE DRAWINGS

FIG. 9 is a block diagram of a vacuum vessel with the ion multiplying device installed in.

DESCRIPTION OF THE PREFERRED EMBODIMENTS

Figure 1:
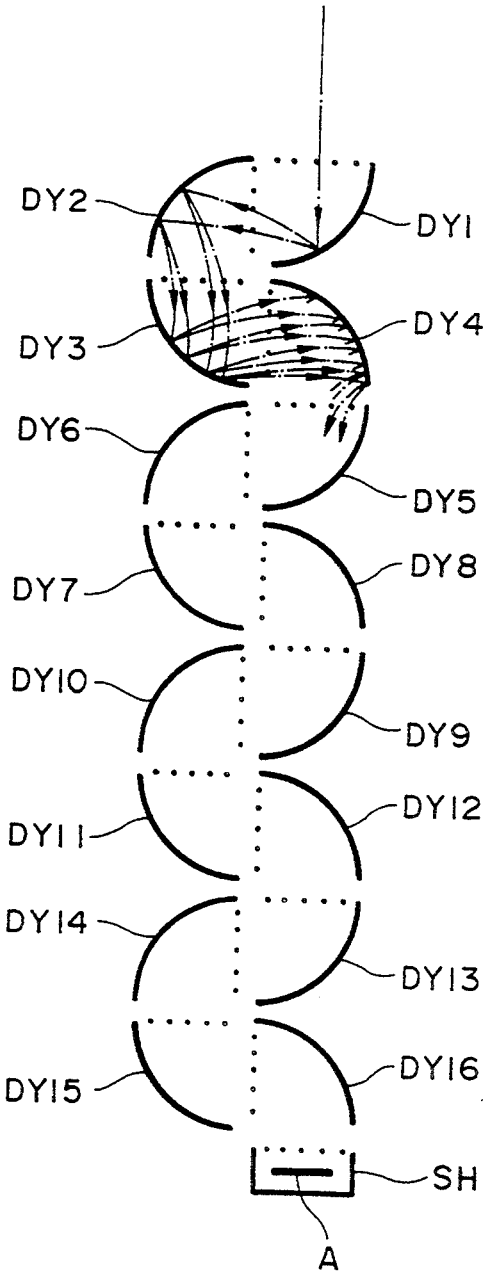
FIG. 1 is a schematic view explaining the principle of the ion multiplying device.

A preferred embodiment of this invention will be explained with reference to the drawings attached hereto.

In the drawings the common members are represented by common reference numerals. In the following description, "vertically, or up to down", and "horizontally, or left to right" means "vertically, or up to down" and "horizontal, or left to right" as viewed in the drawings.

Figure 4:
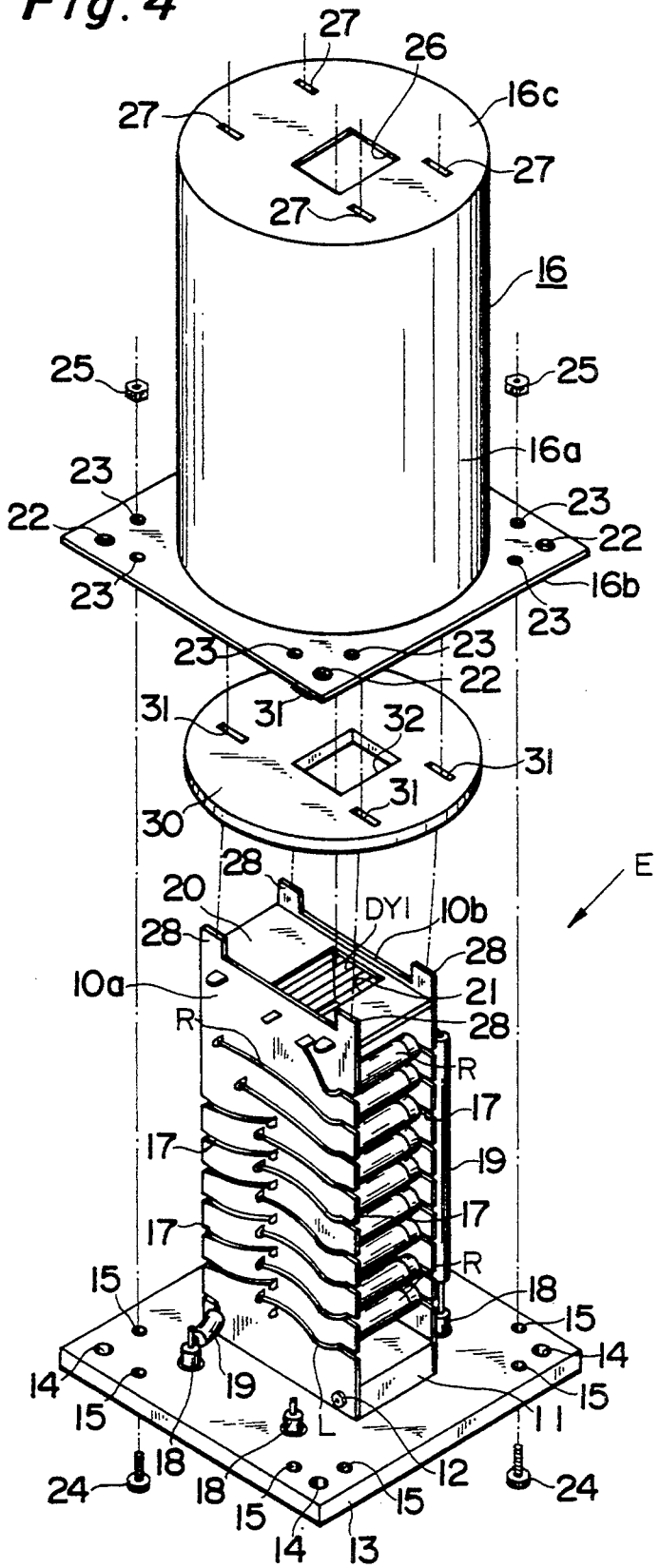
FIG. 4 is a broken-down perspective view of the ion multiplying device according to one embodiment of this invention.
Figure 5:
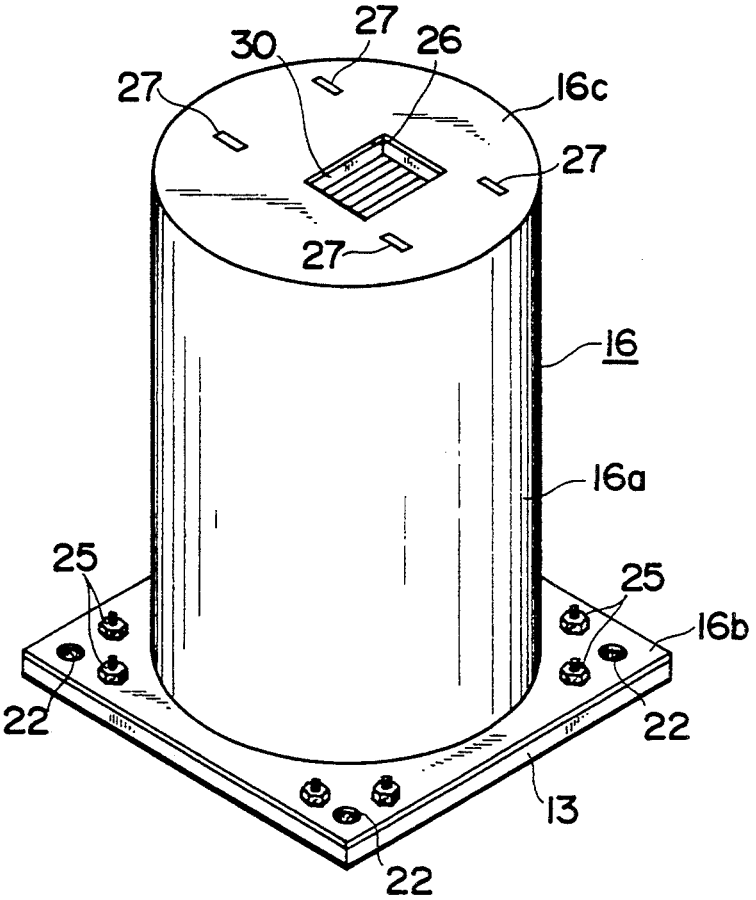
FIG. 5 is a perspective view of the finished ion multiplying device of FIG. 4.
Figure 6:
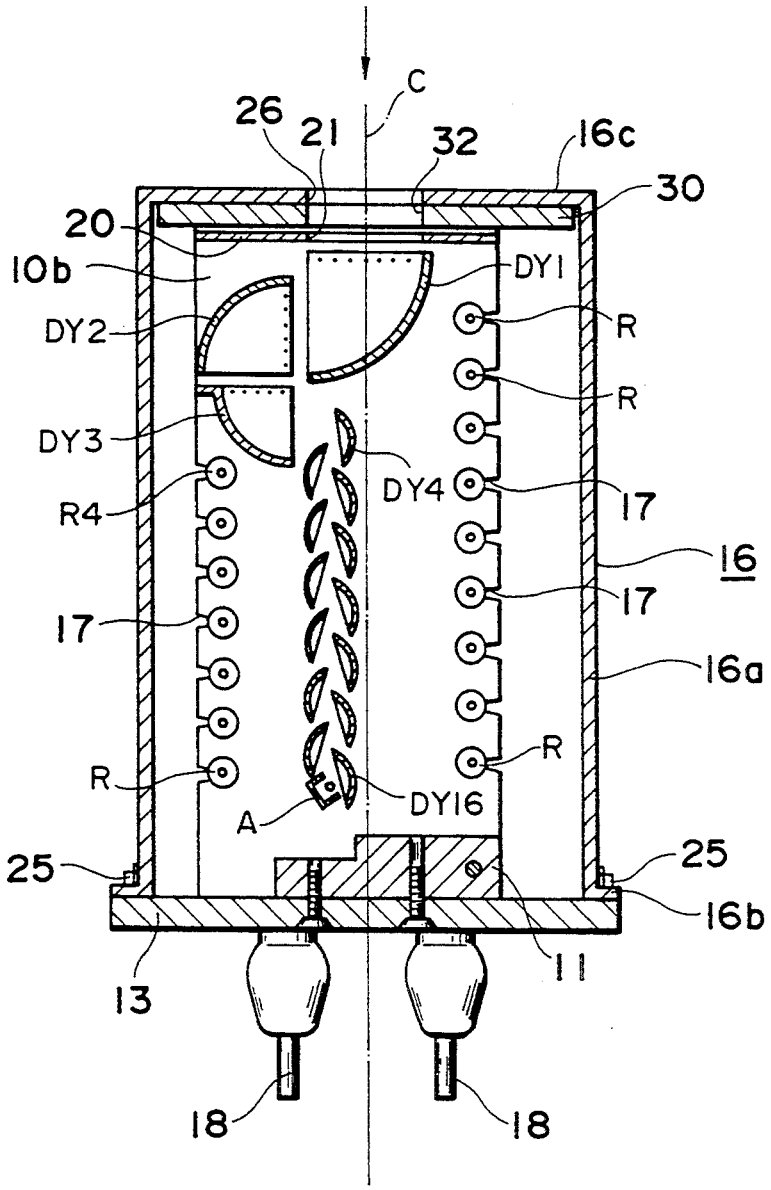
FIG. 6 is a longitudinal sectional view of the ion multiplying device of FIG. 4.
Figure 8:
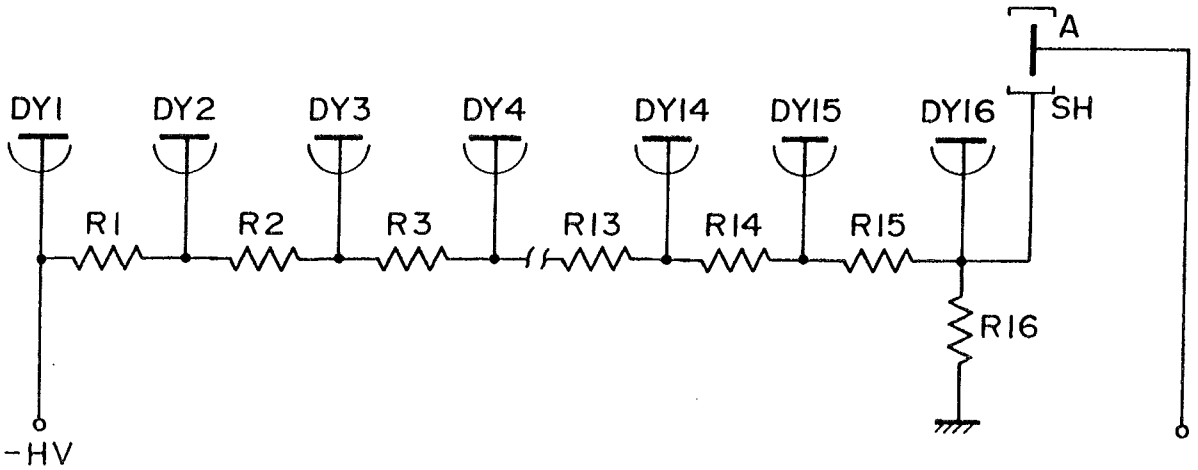
FIG. 8 is a circuit diagram of a voltage dividing circuit used in the ion multiplying device of FIG. 4.

As shown in FIGS. 4 to 6, the ion multiplying device according to one embodiment of this invention includes, as does the above-described conventional device, an ion multiplying unit E including a plurality of stages of dynodes DY (16 stages in this embodiment), and a collecting electrode (anode) for capturing electrons emitted from the final-stage dynode DY 16. The respective dynodes DY have a potential difference with respect to their downwardly adjacent ones so that they emit secondary electrons to the latter. To this end, the ion multiplying unit E includes a voltage dividing circuit of FIG. 8. Resistors R are inserted between the respective dynodes and their adjacent ones. A resistor R is inserted between the final-stage dynode DY 16 and the earth.

In this embodiment, the resistors R, the dynodes DY and the collecting electrode A are mounted between two support plates 10*a*, 10*b* of ceramics which are parallel with each other. Each support plate 10*a*, 10*b* is substantially rectangular. A block 11 is secured to one ends of the support plates 10*a*, 10*b* between both support plates by bolts and nuts 12. The block 11 is secured by screws to the central portion of a substantially square base 13. Thus the support plates 10*a*, 10*b* are fixed to the base 13 in parallelism with each other.

The base 13 is formed of a relatively thick stainless steel plate, and is so rigid that the base 13 is not deformed by normal uses. In each corner of the base 13 there are formed three holes 14, 15, 15. The hole 14 nearest to the corner is for mounting the ion multiplying device to, e.g., a vacuum vessel (not shown). The other holes 15, 15 are for mounting on the base 13 a casing which will be described later.

As shown in FIG. 6, the dynodes DY are arranged substantially alternately between the support plates 10*a*, 10*b* in the longitudinal direction thereof. The first-stage to the third-stage dynodes DY1~DY3 which are relatively larger are arranged in the so-called box-and-grid-type arrangement, and the other smaller dynodes DY4~DY 16 are arranged in the so-called line focus-type arrangement or linear focus arrangement. In this arrangement, an energy beam enters along the longitudinal axis of the support plates 10*a*, 10*b* and impinges on the concave surface of the first-stage dynode DY1, and secondary electrons are emitted to multiply electrons. The secondary electrons are led to the concave surface of the second-stage dynode DY2. Thus secondary electrons are led to a next stage-dynode and finally to the last-stage dynode DY16, which is nearest to the base 13.

The collecting anode A is disposed at a position where the anode A can receive the electrons emitted from the final-stage dynode DY 16.

A plurality of recesses are formed at a set interval in the longitudinal edges to each support plate 10*a*, 10*b*. The resistors of the voltage dividing circuit are mounted between the support plates 10*a*, 10*b* by the recesses 17. A resistor R is disposed between a pair of the recesses at the same height and is secured by inserting the leads of the resistors in recesses of the pair with the forward ends of the leads welded to the forward ends of tabs of the associated dynode DY. In this embodiment, 9 resistors R are disposed on one side, and on the other side 7 resistors are disposed.

The first-stage dynode DY1, the collecting electrode A and the final-stage dynode DY16 are connected to hermetic terminals 18 by a ceramic piped conductor 19.

A metal plate 20 is mounted between the upper ends of the support plates 10*a*, 10*b*. In the metal plate there is formed an incidence opening 21 at a position opposed to an energy beam entrance of the first-stage dynode DY1. This metal plate 20 is connected to the first-stage dynode DY1 to have the same potential as the latter so that the metal plate has shielding function and also as a reinforcement of the ion multiplier assembly.

The ion multiplier according to this embodiment further comprises a casing 16 for protectively housing the dynodes DY, etc. The casing 16 has a shape of an upside-down cup, and includes a cylindrical portion 16*a* surrounding the support plates 10*a*, 10*b* secured to the base 13 and the hermetic terminals 18, an outward flange 16*b* formed in one-piece on the lower end of the cylindrical portion 16*a*, and a top source 16*c* closing the top of the cylindrical portion 16*a*. It is preferable that the casing 16 is made of a magnetic metal, Permalloy or others, for the protection from the influence of the magnetic field.

The flange 16*b* has a substantially rectangular shape as the base 13. Three holes 23, 22, 23 are formed in each corner of the flange 16*b*. When the casing 16 is mounted on the base 13 at a set position, each corner of flange 16*b* and that of the base 13 agree with each other with the holes 23, 22, 23 and the holes 15, 14, 15 respectively aligned with each other. A vis 24 is inserted through the inner holes 15, 23 and is fastened with a nut 25 to thereby secure the casing to the base 13.

An entrance window 26 is formed in the top surface of the casing 16. The entrance window 26 is for inletting energy beams and is brought into alignment with the incidence opening 21 of the metal plate 20 and with the energy beam entrance of the first-stage dynode DY1.

In this embodiment, in the top surface of the casing 16 there are formed 4 slots 27 in addition to the entrance window 26. The slots 27 receive tabs formed upward on the upper edges of the support plates 10*a*, 10*b* when the casing 16 is mounted on the base 13 at the set position. The assembly of the slots 27 and the tabs 28 facilitate the positioning of the casing 16, and the alignment of the incidence opening 21 with the entrance window 26.

The ion multiplying device according to this embodiment is secured by bolts to a mounting place, such as a vacuum flange or others, by means of the holes 14, 22 of the base 13 and of the flange of the base 16. The casing 13 has a rigidity sufficient to secure the ion multiplying unit E to the set position. Since the dynodes DY, etc. are housed in the casing 16, the fabricating operation can be made without paying special attention to their interference with the other members.

Figure 9:
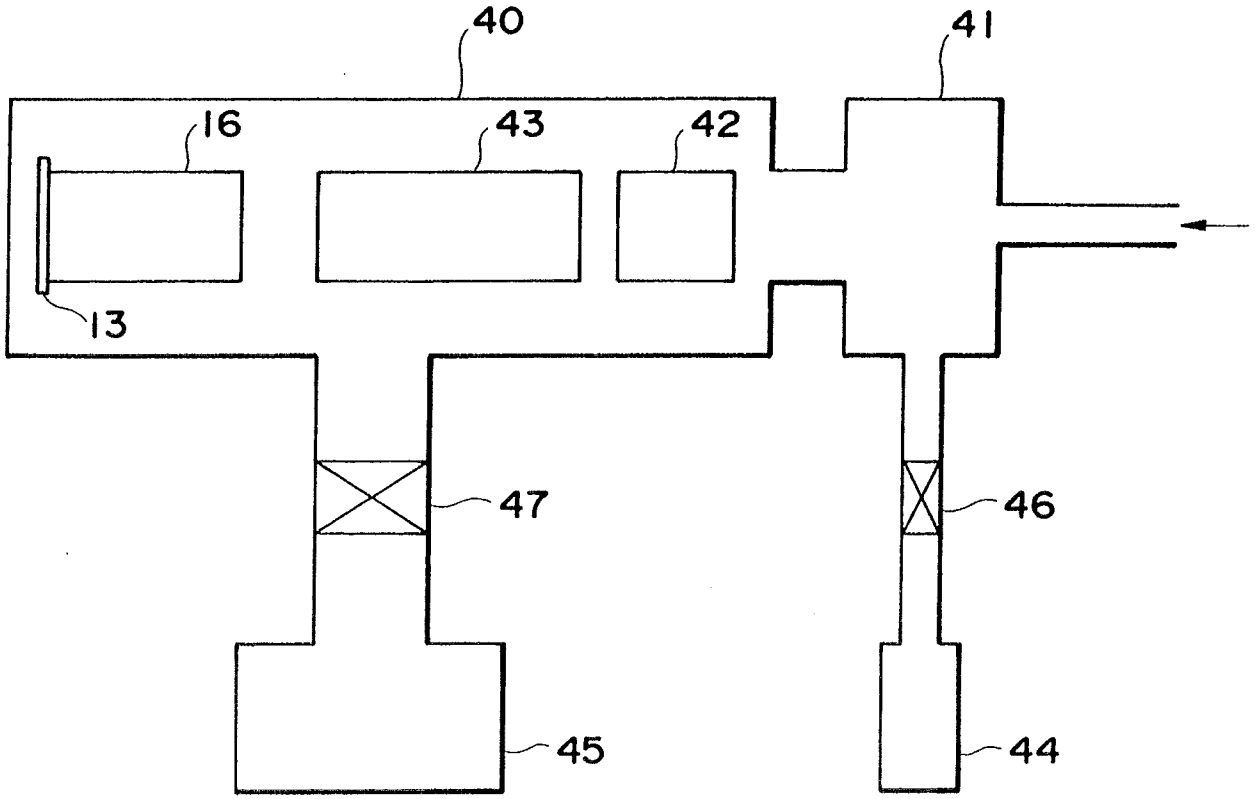

FIG. 9 shows the ion multiplying device disposed in a vacuum vessel 40. The device of FIG. 9 is a Mass spectra analyzer. Inside the vacuum vessel 40 the ion multiplying device is disposed on the left end. A sample gas introduction chamber 41 is disposed opposed to the ion multiplying device for introducing sample gas into the vacuum vessel 40. In the vacuum vessel 40 there is provided an ion source 42 for ionizing the introduced sample gas and emitting ionized particles to the ion multiplying device. The ionized particles emitted from the ion source 42 take curved orbits when they pass through the ion analyzer 43, and only specific ones of the ionized particles selectively arrive at the ion multiplying device. Vacuum pumps 44, 45 are connected to the sample gas introduction chamber 41 and the vacuum chamber 40 respectively through a vacuum valves 46, 47 so that residual gas in their associated spaces are evacuated to maintain the interiors of the spaces at a vacuum atmosphere.

In the case that the ion multiplying device is mounted in a vacuum vessel as in this case, the interior of the vessel is evacuated before a measurement, but the dynodes DY, etc., which are housed in the casing 16 are not exposed to the air flow. The risk of dust sticking to the dynodes DY is much reduced. Even when the dynodes DY are left in the air, the dynodes DY housed in the casing 16 are much less contaminated in comparison with those without the casing 16. Gain deterioration of the ion multiplying device due to backward diffusion of vacuum oil, sample solvents, etc. in an evacuating operation can be much reduced.

The casing 16 shields off energy beams, as of neutrons, which might be irregularly reflected to adversely enter the ion multiplying device from the sides, and background ultraviolet radiation in mass analysis preventively from entering the dynodes DY.

The casing 16 made of a magnetic metal, such as Permalloy, functions as an electromagnetic shield and prevents the influence due to magnetic fields and electric fields of incident energy beams.

In FIGS. 4 and 6, reference numeral 30 represents an insulator (filler plate). The insulator 30 is disposed between the metal plate 20 and the top surface 16c of the casing 16. In the central part of the insulator 30 there is formed a passage opening 32 of the same shape as the entrance window 26 and the incidence opening 21. A gap is formed between the top surface 16c of the casing 16 and the metal plate 20. There is a very low possibility that dust and unnecessary energy beams which have entered through the entrance window 26 intrude into the casing 16 through the gap. But the insulator 30 can perfectly prohibit the intrusion of the dust, etc.

The insulator 30 can have various forms. It is preferable for sealing the gap that is shown, the insulator 30 has a cylindrical shape having an outer diameter substantially equal to an inner diameter of the casing 16. In the case that the insulator 30 has such cylindrical shape, positioning slots 31 are formed in the insulator 30 so as to be into alignment with the slots 27 . The tabs 28 of the support plates 10*a*, 10*b* are inserted into the slots 31 and the slots 27, whereby the passage opening 32 of the insulator 30 for inletting energy beams is brought into alignment with the entrance window 26 of the casing 16, the incidence opening 21 of the metal plate 20 and the energy beam receiving surface of the first-stage dynode DY 1.

Figure 7:
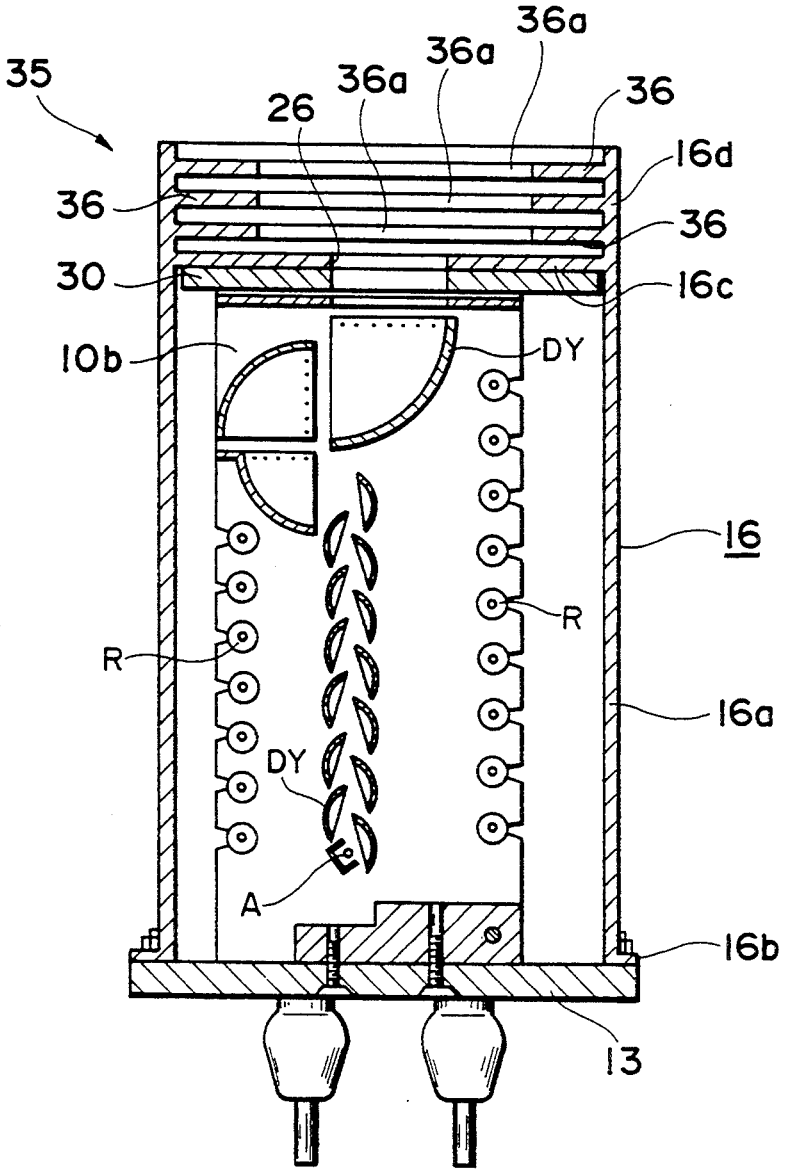
FIG. 7 is a sectional view of a modification of the casing used for the ion multiplying device of FIG. 4.

FIG. 7 is a sectional view of another example of the casing 16. This example is different from the casing involved in the above-described embodiment in that in the former the upper end of a cylindrical portion 16*a* of the casing 16 is extended upward beyond a top surface 16*c*. A baffle (energy beam introducing members) 35 in the form of a plurality of rings is mounted on the inside peripheral surface of the extended portion 16*d* of the cylindrical portion 16*a*.

The baffle 35 comprises a plurality of metal plates 36 each having both sides colored in black. Each metal plate 36 has an opening formed in central part thereof. The opening 36*a* is larger than the entrance window 26 below the metal plate 36. The openings of the respective metal plates define an energy beam introducing hole. The baffle 35 is for absorbing or reflecting energy beams entering from the sides, which are not to be measured so as to prohibit their entrance through the entrance window 26 of the casing 16. Because of the baffle 35, background ultraviolet radiation and neutral moleculed, etc. which are problems with mass analysis can be usefully reduced. The baffle 35 can have various shapes for preventing the intrusion of the background molecules and ultraviolet radiation.

Figure 2:
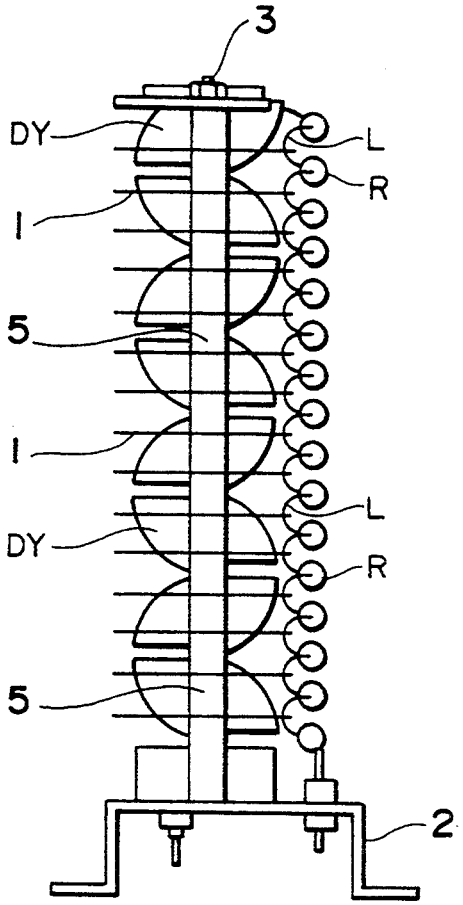
FIG. 2 is a side view of the conventional general ion multiplying device.
Figure 3:
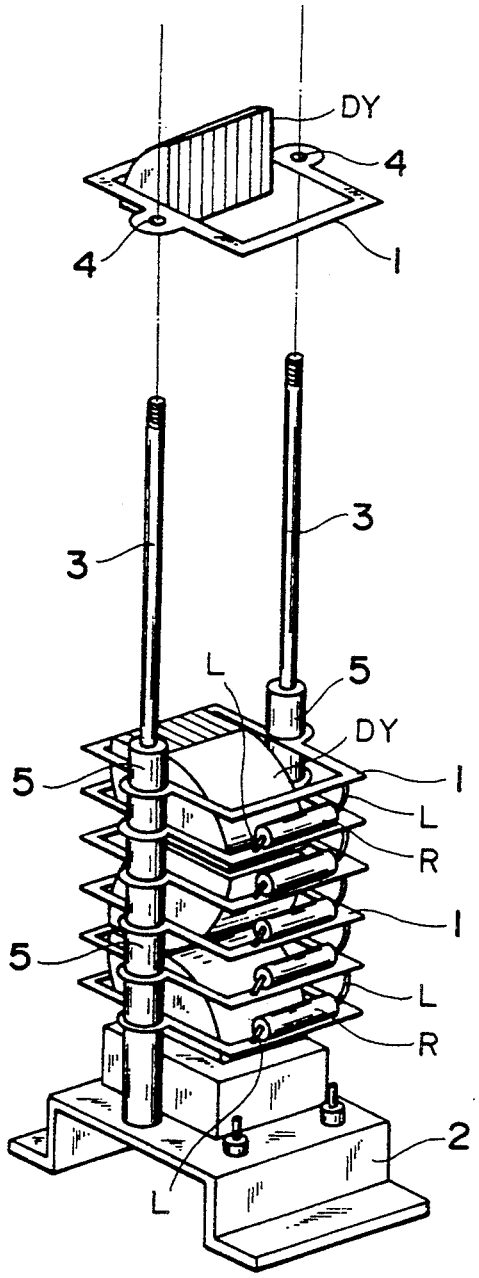
FIG. 3 is a perspective view of the ion multiplying device of FIG. 2 being assembled.

In the above-described embodiment, the dynodes DY housed in the casing 16 are mounted on the two support plates 10*a*, 10*b*, but this invention is also applicable to the structure of, e.g., FIG. 2.

As described above, the ion multiplying device according to this invention includes the casing. The casing can protect the ion multiplying unit E including the dynodes and the resistors, etc. from unnecessary energy beams not to be measured and dust, the backward diffusion of vacuum oil and sample solvents, etc. Unnecessary energy beams cause noises, and to shield off the unnecessary energy beams improves achievement of the ion multiplying device. Dust, vacuum oil, etc. are hindered from sticking to the dynodes, whereby the deterioration of gains of the ion multiplying device can be precluded.

The casing protects the dynodes, etc. from external forces, such as impacts, etc. The base has a sufficient rigidity which facilitates the handling the ion multiplying device.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A device for receiving an energy beam and multiplying secondary electrons corresponding to the energy beam, comprising:

a base having a main surface which faces in an incident direction of the energy beam;

an electron multiplying unit mounted on the main surface of said base, said electron multiplying unit including:

a plurality of dynodes arranged in a plurality of stages and stacked with respect to an incident direction of the energy beam, a first dynode within said dynodes receiving the energy beam and emitting the secondary electrons; and a housing supporting said dynodes, said housing being defined by:

a pair of support plates being arranged on opposing sides of each dynode, said support plates sandwiching and supporting said dynodes; and a metal plate having an incidence opening for the energy beam passing therethrough and being electrically connected to said first dynode, said metal plate directly contacting and sandwiched by said support plates; and a casing housing said electron multiplying unit therein and being secured to the main surface of said base, said casing having a top surface which is directly exposed to the energy beam, the top surface of said casing having an entrance window for the energy beam passing therethrough.

2. A device according to claim 1, wherein said casing is formed of a magnetic metal.

3. A device according to claim 1, wherein said casing has positioning slots formed therein; and said pair of support plates have tabs to be inserted in the slots when said casing is secured to said base.

4. A device according to claim 1, installed in a vacuum vessel residual air in which evacuated, and an interior of which is maintained at a set degree of vacuum.

5. A device according to claim 1, wherein an area of said main surface of said base is larger than that of said top surface of said casing.

6. A device according to claim 1, wherein said electron multiplying unit further comprises a voltage dividing circuit including a plurality of resistors for applying a suitable potential to each of said dynodes, each of said resistors being electrically connected to an adjacent resistor within said resistors, and wherein said support plates are arranged on opposing sides of each resistor, and sandwiching and supporting said plurality of resistors with said dynodes.

7. A device according to claim 6, wherein a dynode within said dynodes is located between each pair of electrically connected resistors respectively.

8. A device according to claim 6, wherein said support plates have recesses extending toward a center from an edge, each of said recesses being located where each resistor is supported, each resistor being fixed to said pair of support plates through a pair of leads which extend from the sides of said resistor, said leads being used to electrically connect said resistors.

9. A device according to claim 1, wherein dynodes within said plurality of dynodes which are located upstream from a secondary electron stream are arranged in a box-and-grid arrangement, and dynodes within said plurality of dynodes which are located downstream from the secondary electron stream are arranged in one of a line-focus arrangement or a liner-focus arrangement.

10. A device according to claim 1, further comprising a filler plate made of an insulating material, said filler plate provided in said casing and filling a space defined by said metal plate and the top surface of said casing, having an opening for the energy beam passing therethrough, and contacting said pair of support plates, whereby said filler plate prevents undesirable energy beams from being introduced into a space between said electron multiplying unit and inner wall of said casing.

11. A device according to claim 10, wherein each of said support plates has a projection for positioning said filler plate.

12. A device according to claim 1, wherein a position at which said entrance window of said casing is provided and a position at which said first dynode is provided correspond to each other with respect to an incident direction of the energy beam, whereby the energy beam which passes through said entrance window of said casing reaches straight to said first dynode.

13. A device according to claim 10, wherein a position at which said entrance window of said casing is provided, a position at which said opening of said filler is provided, and a position at which said first dynode is provided correspond to each other with respect to an incident direction of the energy beam, whereby the energy beam which passes through said entrance window of said casing reaches straight to said first dynode.

14. A device according to claim 1, wherein a side wall of said casing projects from said top surface toward an incident side of said energy beam.

15. A device according to claim 11, wherein said energy beam introducing member has a larger opening than said entrance window of said casing, and comprises black-colored plates disposed in a plurality of stages spaced by a certain interval.

16. A device according to claim 1, wherein said casing has a side wall which is extended to an incident direction the energy beam, an energy beam introducing member directly contacting an inner surface of said side wall.

17. A device according to claim 1, further comprising a vessel of which the inner pressure is set negative, said device according to claim 11 provided in said vessel.

18. A device according to claim 17, further comprising an ion surface for emitting an energy beam to said device according to claim 11, said ion source provided in said vessel.

19. A device for receiving an energy beam and multiplying secondary electrons corresponding to the energy beam, comprising:

a base having a first main surface which faces in an incident direction of the energy beam and a second main surface opposite to the first main surface;

an electron multiplying unit mounted on the first main surface of said base, said electron multiplying unit including:

a plurality of dynodes arranged in a plurality of stages and stacked with respect to an incident direction of the energy beam, a first dynode within said dynodes receiving the energy beam and emitting the secondary electrons; and a housing supporting said dynodes, said housing being defined by:

a pair of support plates sandwiching and supporting said dynodes, said support plates being located so as to cross surfaces of dynodes, said surfaces receiving secondary electrons, whereby said pair of support plates encloses a space defined by said dynodes which face to each other; and a metal plate having an incidence opening for the energy beam passing therethrough and being electrically connected to said first dynode, said metal plate directly contacting said sandwiched by said support plates; and a casing housing said electron multiplying unit therein and being secured to the first main surface of said base, said casing having a top surface which is directly exposed to the energy beam, the top surface of said casing having an entrance window for the energy beam passing therethrough.

20. A device according to claim 19, further comprising a filler plate made of an insulating material, said filler plate provided in said casing and filling a space defined by said metal plate and the top surface of said casing, having an opening for the energy beam passing therethrough, and contacting said pair of support plates, whereby said filler plate prevents undesirable energy beams from being introduced into a space between said electron multiplying unit and an inner wall of said casing.

21. A device according to claim 19, wherein said base has terminals extending from the second surface of said base to a reverse direction of the first main surface of said base.

* * * * *